US009194557B2

(12) United States Patent
Wu

(10) Patent No.: US 9,194,557 B2
(45) Date of Patent: Nov. 24, 2015

(54) LIGHT SOURCE DEVICE

(71) Applicant: HON HAI PRECISION INDUSTRY CO., LTD., New Taipei (TW)

(72) Inventor: Kun-Chan Wu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 149 days.

(21) Appl. No.: 14/053,575

(22) Filed: Oct. 14, 2013

(65) Prior Publication Data

US 2015/0062920 A1 Mar. 5, 2015

(30) Foreign Application Priority Data

Aug. 27, 2013 (CN) ..... 2013 1 0376110

(51) Int. Cl.

| | |
|---|---|
| ***F21V 5/00*** | (2015.01) |
| ***F21K 99/00*** | (2010.01) |
| ***F21V 5/04*** | (2006.01) |
| *F21Y 101/02* | (2006.01) |

(52) U.S. Cl.

CPC . *F21V 5/008* (2013.01); *F21K 9/50* (2013.01); *F21V 5/04* (2013.01); *F21Y 2101/02* (2013.01)

(58) Field of Classification Search

CPC ..... F21V 5/008; F21V 5/04; F21V 5/048; F21K 9/50

USPC ..... 362/311.02

See application file for complete search history.

(56) References Cited

U.S. PATENT DOCUMENTS

| | | | | |
|---|---|---|---|---|
| 6,019,493 | A * | 2/2000 | Kuo et al. | 362/335 |
| 6,755,556 | B2 * | 6/2004 | Gasquet et al. | 362/329 |
| 7,572,036 | B2 * | 8/2009 | Yoon et al. | 362/331 |
| 7,748,872 | B2 * | 7/2010 | Holder et al. | 362/308 |
| 7,963,680 | B2 * | 6/2011 | Yoon et al. | 362/336 |
| 8,449,150 | B2 * | 5/2013 | Allen et al. | 362/311.06 |
| 8,696,175 | B2 * | 4/2014 | Yoon et al. | 362/335 |
| 2010/0195335 | A1 * | 8/2010 | Allen et al. | 362/309 |

* cited by examiner

*Primary Examiner* — Anabel Ton

(74) *Attorney, Agent, or Firm* — Novak Druce Connolly Bove + Quigg LLP

(57) ABSTRACT

The present disclose relates to a light source device, which includes a first lens, a second lens, a third lens and a light source. The first lens includes a first light input surface and a first convex surface opposite to the first light input surface. The first convex surface has a first curvature. The second lens includes a second light input surface and a second light output surface opposite to the second light input surface. The second light input surface defines a concave surface at a center thereof. The third lens includes a deviating portion arranged between the first convex surface of the first lens and the concave surface of the second lens. A light source faces the first light input surface of the first lens.

14 Claims, 4 Drawing Sheets

LIGHT SOURCE DEVICE

BACKGROUND

1. Technical Field

The disclosure relates to light source devices, and particularly to a light source device with a larger radiation angle.

2. Discussion of Related Art

Light emitting diodes' (LEDs) many advantages, such as high luminosity, low operational voltage, low power consumption, compatibility with integrated circuits, faster switching, long term reliability, and environmental friendliness have promoted their wide use as a lighting source.

However, the conventional LED cannot have a wide illumination area even use with a diverging lens. The light having a large incidence angle on the light emerging face of the diverging lens, may be totally reflected backwardly into the diverging lens. Thus, the radiation angle of the light emitted out of the diverging lens is limited, generally less than 120 degrees. In other words, the light intensity dramatically decreases when the radiation angle exceeds 120 degrees.

Therefore, what is needed is a light source device which can overcome the described limitations.

BRIEF DESCRIPTION OF THE DRAWINGS

Many aspects of the disclosure can be better understood with reference to the following drawing. The components in the drawing are not necessarily drawn to scale, the emphasis instead being placed upon clearly illustrating the principles of the present light emitting diode device for microminiaturization. Moreover, in the drawing, like reference numerals designate corresponding parts throughout the whole view.

DETAILED DESCRIPTION OF EMBODIMENTS

Figure 1:
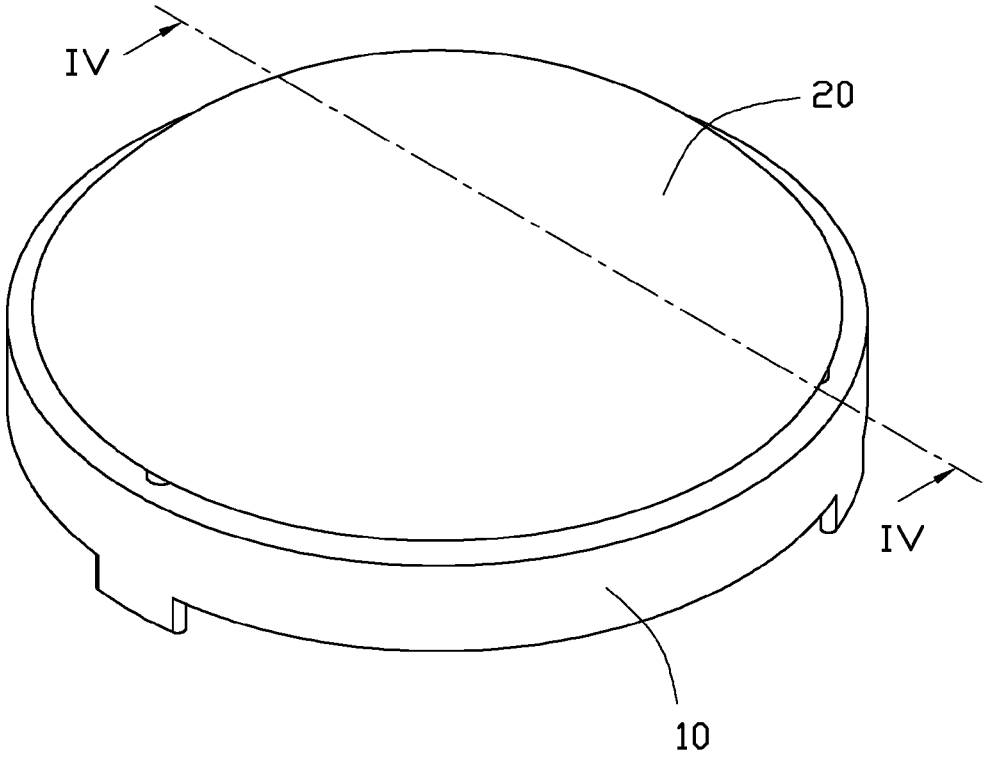
FIG. 1 is a schematic, isometric view of a light source device according to an exemplary embodiment.
Figure 2:
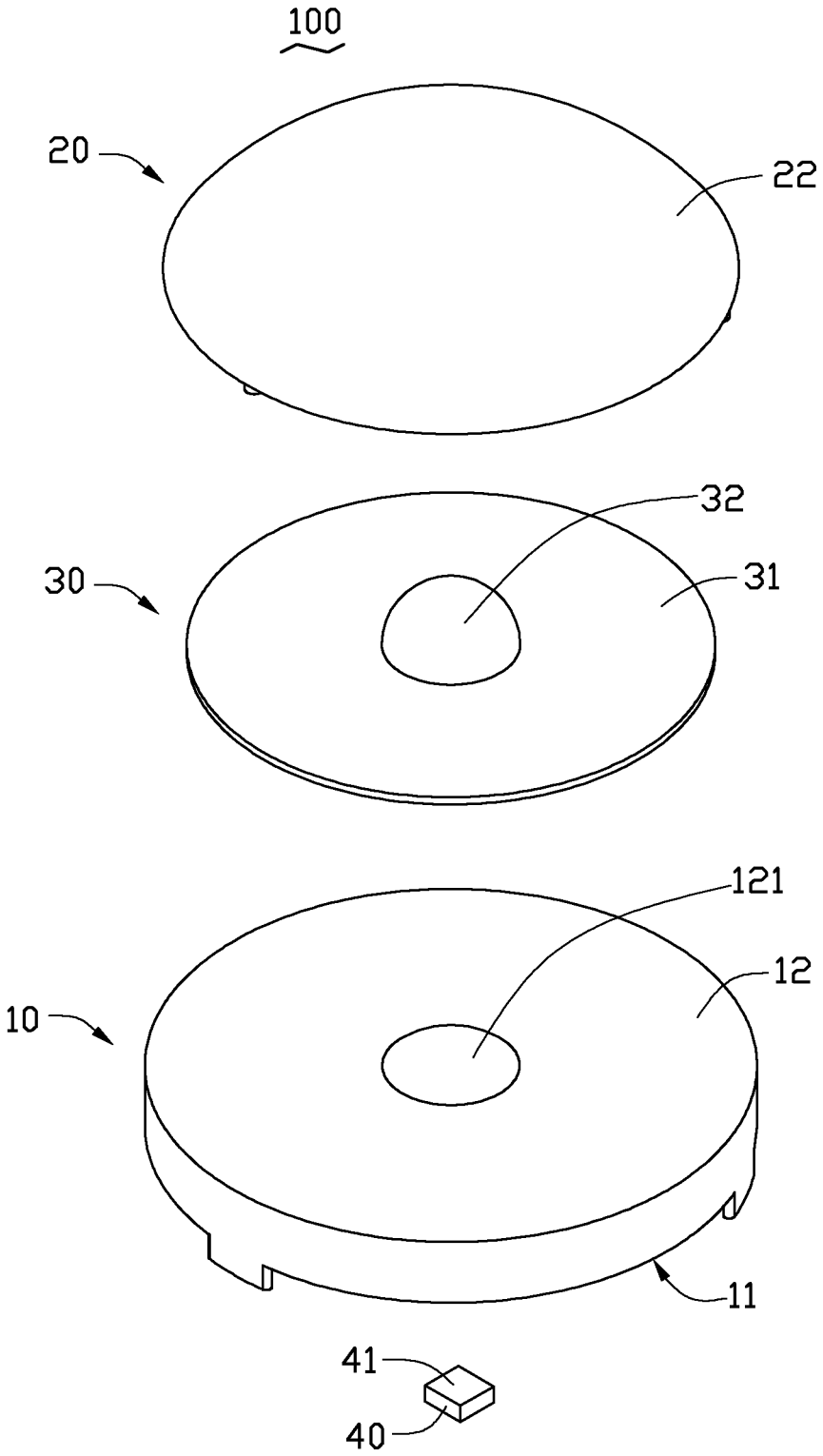
FIG. 2 is a disassembled view of the light source device of FIG. 1.
Figure 3:
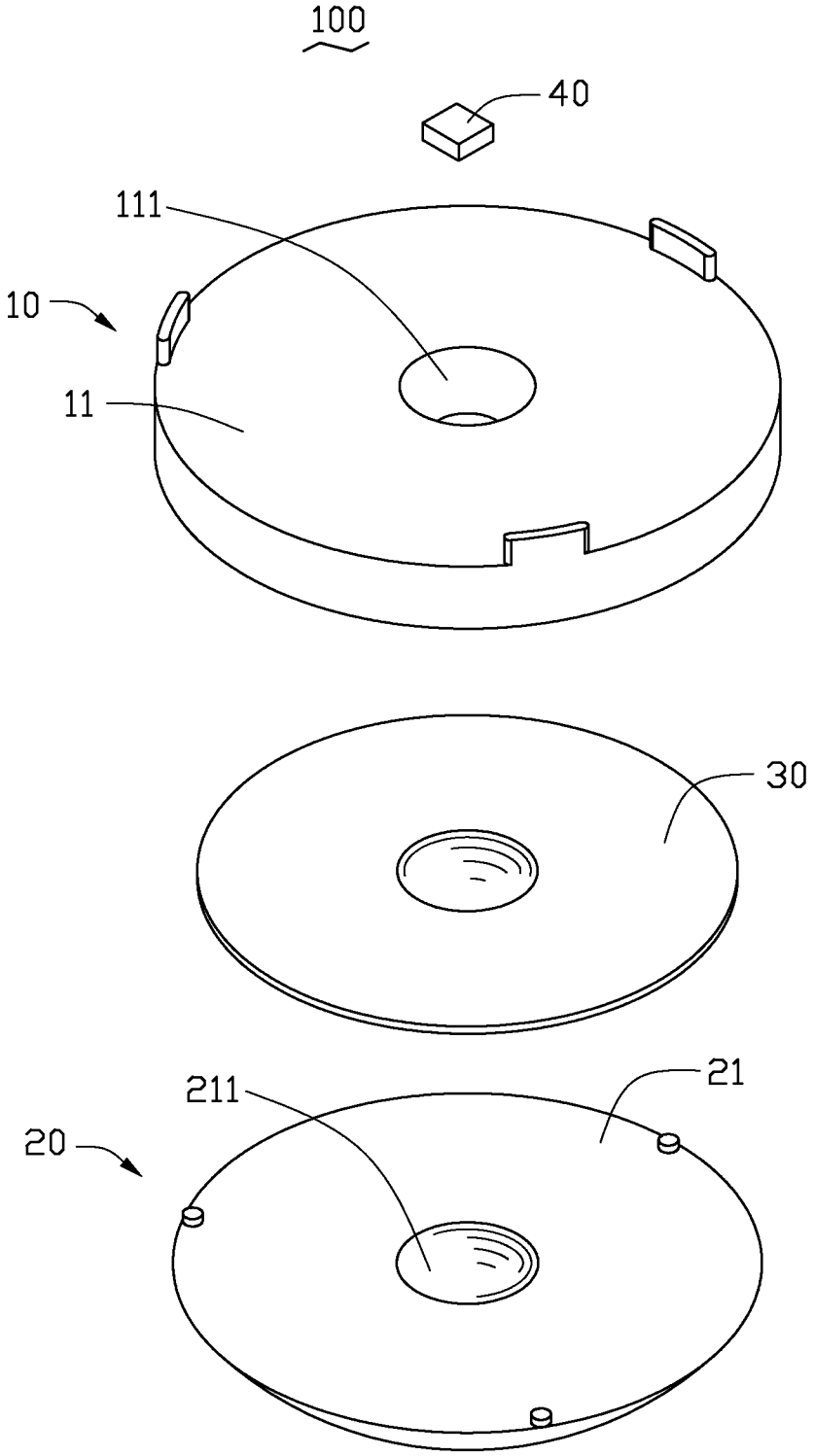
FIG. 3 is an inverted view of the light source device of FIG. 2.
Figure 4:
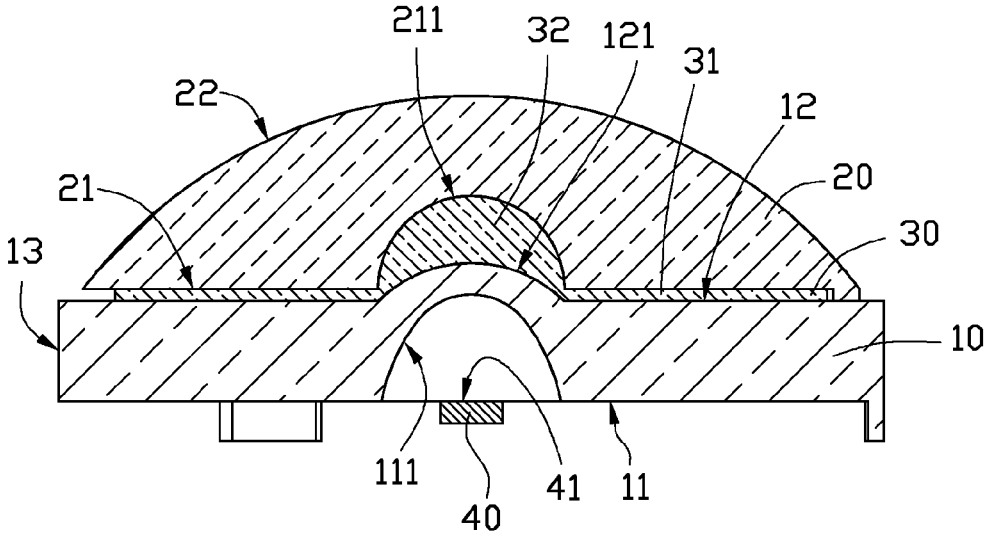
FIG. 4 is a cross-sectional view of the light source device of FIG. 1, taken along line IV-IV thereof.

Referring to FIGS. 1 to 4, a light source device 100 in accordance with an exemplary embodiment of the present disclosure is illustrated. The light source device 100 includes a first lens 10, a second lens 20, a third lens 30 and a light source 40.

The first lens 10 include a bottom surface 11, a top surface 12 opposite to the bottom surface 11, and a side surface 13 connected to the bottom surface 11 and the top surface 12. A first light input surface 111 is an aspheric surface depressing from a center of the bottom surface 11 towards the top surface 12 of the first lens 10. A first convex surface 121 protrudes upwardly from a center of the top surface 12. The first convex surface 121 has a first curvature. The side surface 13 is a total reflective surface. The top surface 12 acts as a first light output surface of the first lens 10. The axis of the first light input surface 111 and the axis of the first convex surface 121 are coaxial to that of the first lens 10. The first lens 10 can be made of polymethyl methacrylate (PMMA) or Polycarbonate (PC).

The second lens 20 includes a second light input surface 21 and a second light output surface 22 opposite to the second light input surface 21. A concave surface 211 is an aspheric surface depressing from a center of the second light input surface 21 towards the second light output surface 22 of the second lens 20. The concave surface 211 has a second curvature which is larger than the first curvature of the first convex surface 121 of the first lens 10. The second light output surface 22 is a convex surface. In the present embodiment, the concave surface 211 of the second lens 20 is opposite to the first convex surface 121 of the first lens 10, and the second light output surface 22 is an aspheric surface. The axis of the concave surface 211 of the second lens 20 is coaxial to that of the first convex surface 121 and the second lens 20. The second lens 20 can be made of polymethyl methacrylate (PMMA) or Polycarbonate (PC).

The third lens 30 is arranged between the first lens 10 and the second lens 20. The third lens 30 includes a deviating portion 32 arranged between the first convex surface 121 of the first lens 10 and the concave surface 211 of the second lens 20 and a surrounding potion 31 surrounding the deviating portion 32. The axis of the first lens 10 and the axis of the second lens 20 are coaxial to that of third lens 30. In the present embodiment, the third lens 30 is formed by adhesive with a given refractive index. The refractive index of the third lens 30 is larger than that of the second lens 20, and less than that of the first lens 10.

The light source 40 is opposite to the first light input surface 111 of the first lens 10. In the present embodiment, the light source 40 is an LED, and the axis of the light source 40 is coaxial to that of the first light input surface 111 of the first lens 10. A light emitting surface 41 of the light source 40 is substantially coplanar with the bottom surface 11 of the first lens 10.

Light beams emitted from the light source 40 enter into the first lens 10 via the first light input surface 111. Then, the light beams are reflected by the side surface 13 and diffused by the first convex surface 121 to enter the third lens 30. The diffused light beams are further diverged by the deviating portion 32 and then enter the second lens 20 through the second light input surface 21. The diverged light beams are scattered by the second light input surface 21 of the second lens 20 to outside. The light beams emitted from the light source 40 are scattered and diverged plural times by the first lens 10, second lens 20 and the third lens 30; therefore, it can enhance the radiation angle of the light source device 100.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A light source device, comprising:

a first lens comprising a bottom surface, a top surface opposite to the bottom surface, and a side surface connected to the bottom surface and the top surface, a first light input surface depressing from a center of the bottom surface towards the top surface, a first convex surface protruding from a center of the top surface, the first convex surface having a first curvature;

a second lens comprising a second light input surface and a second light output surface opposite to the second light input surface, a concave surface depressing from a center of the second light input surface towards the second light output surface, the concave surface having a second curvature which is larger than the first curvature of the first convex surface, the concave surface being opposite to the first convex surface of the first lens;

a third lens arranged between the first lens and the second lens, the third lens comprising a deviating portion arranged between the first convex surface of the first lens and the concave surface of the second lens; and a light source facing the first light input surface of the first lens.

2. The light source device of claim 1, wherein the third lens further comprises a surrounding portion surrounding the deviating portion, the surrounding portion being sandwiched between the first lens and the second lens.

3. The light source device of claim 1, wherein a central axis of the first light input surface is coaxial to that of the first convex surface.

4. The light source device of claim 1, wherein a central axis of the concave surface of the second lens is coaxial to that of the second lens.

5. The light source device of claim 1, wherein a central axis of the first lens is coaxial to that of the second lens and the third lens.

6. The light source device of claim 1, wherein the first light input surface is an aspheric surface.

7. The light source device of claim 1, wherein the second light output surface of the second lens is an aspheric surface.

8. The light source device of claim 1, wherein the refractive index of the third lens is larger than that of the second lens, and less than that of the first lens.

9. The light source device of claim 1, wherein the light source is an LED, and a central axis of the light source is coaxial to that of the first light input surface of the first lens.

10. A light source device, comprising:

a light source;

a first lens comprising a first light input surface opposite to the light source and a first convex surface opposite to the first light input surface, the first light input surface being an aspheric surface, the first convex surface having a first curvature;

a second lens comprising a second light input surface opposite to the first convex surface of the first lens and a second light output surface opposite to the second light input surface, a concave surface depressing from a center of the second light input surface towards the second light output surface, the concave surface having a second curvature which is less than the first curvature of the first input surface; and a third lens arranged between the first lens and the second lens, the third lens comprising a deviating portion arranged between the first convex surface of the first lens and the concave surface of the second lens.

11. The light source device of claim 10, wherein the third lens further comprises a surrounding portion surrounding the deviating portion, the surrounding portion being sandwiched between the first lens and the second lens.

12. The light source device of claim 10, wherein a central axis of the first light input surface is coaxial to that of the first convex surface.

13. The light source device of claim 10, wherein a central axis of the concave surface of the second lens is coaxial to that of the second lens.

14. The light source device of claim 10, wherein a central axis of the first lens is coaxial to that of the second lens and the third lens.

* * * * *